US006523768B2

(12) United States Patent
Recker et al.

(10) Patent No.: US 6,523,768 B2
(45) Date of Patent: Feb. 25, 2003

(54) ROTARY MILL HAVING RELEASABLE WEDGE-LOCK TOOL INSERT HOLDING SYSTEM

(75) Inventors: Jeffrey M. Recker, Mt. Pleasant, MI (US); Gary J. Cotter, Weidman, MI (US)

(73) Assignee: Morbark, Inc., Winn, MI (US)

( * ) Notice: Subject to any disclaimer, the term of this patent is extended or adjusted under 35 U.S.C. 154(b) by 128 days.

(21) Appl. No.: 09/812,455

(22) Filed: Mar. 20, 2001

(65) Prior Publication Data

US 2001/0045478 A1 Nov. 29, 2001

Related U.S. Application Data

(60) Provisional application No. 60/192,929, filed on Mar. 29, 2000.

(51) Int. Cl.[7] ..... B02C 13/28
(52) U.S. Cl. ..... 241/294; 29/428
(58) Field of Search ..... 29/428; 144/230; 241/294, 189.1, 242

(56) References Cited

U.S. PATENT DOCUMENTS

| | | | |
|---|---|---|---|
| 139,105 | A | 5/1873 | Barr |
| 1,681,675 | A | 8/1928 | Miller |
| 1,951,101 | A | 3/1934 | Miller |
| 2,042,893 | A | 6/1936 | Haskell |
| 2,331,555 | A | 10/1943 | Jostich, Jr. et al. |
| 2,747,803 | A | 5/1956 | Hanse |
| 2,784,753 | A | 3/1957 | Kliem et al. |
| 2,842,233 | A | 7/1958 | Greenleaf |
| 4,057,294 | A | 11/1977 | Krekeler |
| 4,821,970 | A | 4/1989 | Puetz |
| 4,930,710 | A | 6/1990 | Hench |
| 5,163,490 | A | 11/1992 | Meis |
| 5,240,192 | A | 8/1993 | Tilby et al. |

*Primary Examiner*—Mark Rosenbaum
(74) *Attorney, Agent, or Firm*—Reising, Ethington, Barnes, Kisselle, Learman & McCulloch, P.C.

(57) ABSTRACT

A rotor assembly for comminuting scrap wood and other like material has a rotor drum including a drive shaft and at least one radially projecting tool supporting member with a tool assembly receiving pocket. A releasable tool is locked in the pocket and comprises a shank, with an outer cutting head thereon, received in the pocket to bear upon the front wall of the pocket. The shank has an inclined front wall matching the inclined front wall of the pocket. A wedge mating member has a more inclined rear surface bearing upon the inclined rear wall of the pocket and a front wall bearing upon the tool shank. The wedge has a threaded opening for a threaded abutment member which is manipulatible to draw the wedge member outwardly to releasably clamp the tool shank.

20 Claims, 9 Drawing Sheets

ROTARY MILL HAVING RELEASABLE WEDGE-LOCK TOOL INSERT HOLDING SYSTEM

The application claims the priority of U.S. Provisional Application No. 60/192,929, filed Mar. 29, 2000.

FIELD OF THE INVENTION

The invention relates to comminuting machinery and, more particularly, to machines which may be referred to as grinders, wood hogs, and hammermills, or particularly disposing of waste scrap wood and the like which is comminutable or fragmentable to chips or shreds.

BACKGROUND OF THE INVENTION

Machines of the general character mentioned have been provided with wedge-locked tool assemblies of a great many designs. The present invention has been developed for particularly treating scrap wood, such as beams from demolished buildings, pallets, old railroad ties, and even forestry wood. Such machinery employs tools which encounter high impact forces and sometimes foreign matter such as nails and-bolts, so that the life of the tooling is not expected to be lengthy. While the life of the tool is determined by many factors, it is axiomatic that the tooling will need to be changed periodically due to wear and possible fracture and, accordingly, the tooling must be readily removable and replaceable.

The life of the tooling is, however, also affected by the rigidity with which the tooling is held, and whether the tooling is securely held in position so that the tools of the drum are all operating in the same axial cutting plane. The wedge-lock tool holding system, which will be described, is-an improved construction over prior art devices designed to provide a longer tool life and ready and rapid replaceability.

SUMMARY OF THE INVENTION

The invention is concerned with a rotor drum made up of one or more radially projecting members driven by a drive shaft and providing a plurality of tool assembly receiving pockets over the periphery of the drum formed for reception of the improved tool assemblies, which are locked in the pockets. The tool employed in the tool assembly has an elongate shank with a cutting head thereon having a cutter tooth with a cutter edge facing in the direction of rotation of the rotor drum. The tool shank is received in the pocket to bear upon the front wall of the pocket and the shank and front wall of the pocket have inclined front walls which extend from the floor of the pocket. The wedge employed has a rear inclined surface bearing upon the rear wall of the pocket and a front wall bearing upon the tool shank and the angle of inclination of the wedge rear surface and rear wall of the pocket is such as to provide a differential inclination with the inclined front surfaces. The wedge member has a threaded opening with an elongate threaded abutment member therein having an inner end extendable to bear upon the pocket floor. The threaded member is rotatable to draw the wedge member outwardly to securely lock the tool shank when manipulated with its inner end in bearing engagement with the pocket floor.

One of the prime objects of the invention is to provide a more reliable tool or knife clamping and securement system which holds the knife securely in position and provides the necessary rigidity for this high impact tool.

Another object of the invention is to provide a rapidly releasable clamping system which permits replacement of the knives or tools when necessary to minimize production down-time.

Another object of the invention is to provide a system which enables the tooling to be set in place accurately and uniformly.

A further object of the invention is to provide a reliable wedge-locking system wherein the tool is mounted in the front of the pocket and the packing of fine wood debris in the pocket which strives to move down the front face of the pocket in prior systems is discouraged.

A further object of the invention is to provide a system wherein the tool bar is supported in the front of the pocket and protects the wedge bolt.

Other objects and advantages of the invention will become apparent with reference to the accompanying drawings and the accompanying descriptive matter.

BRIEF DESCRIPTION OF THE DRAWINGS

The presently preferred embodiment of the invention is disclosed in the following description and in the accompanying drawings, wherein.

DETAILED DESCRIPTION OF THE DRAWINGS

Figure 1:
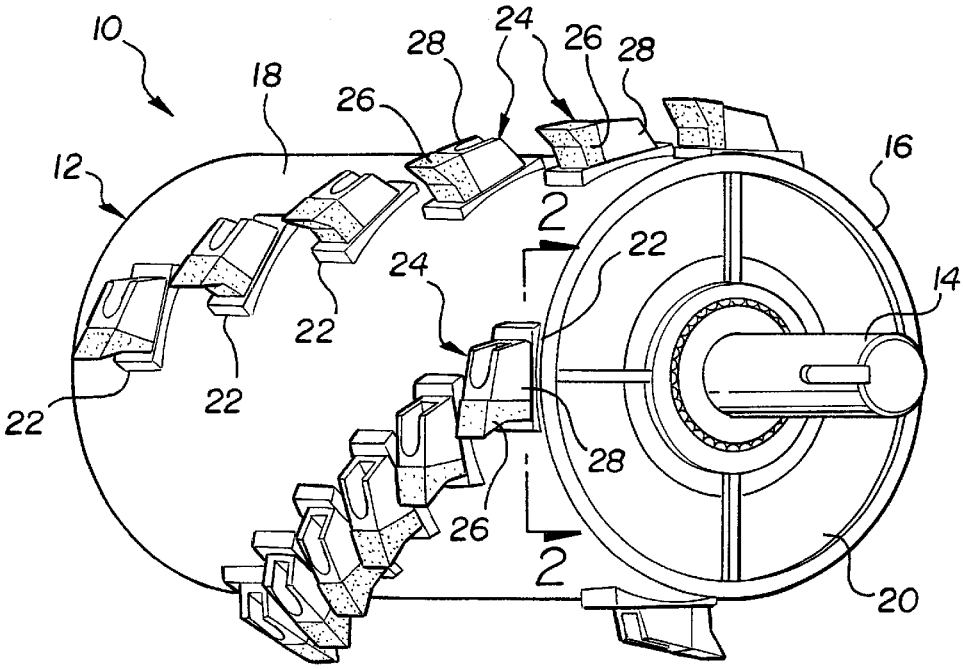
FIG. 1 is a schematic perspective elevational view of a rotor drum.

Referring initially to FIGS. 1–8 in the first instance, a rotary drum 10 is shown as having a generally cylindrical drum body 12 fixed on a shaft 14 for driven rotation about an axis A of the shaft within the reducing chamber (not shown) of a comminuting machine, such as that disclosed in U.S. Pat. No. 5,713,525, incorporated herein by reference, for use in reducing recyclable waste wood and other comminutable material to chips or shreds.

The drum body may be constructed from a cylindrical shell or skin 16 having an outer cylindrical surface 18 and coupled to the shaft 14 by end caps 20. A plurality of recesses or pockets 22 are fixed at predetermined spaced locations across the surface 18 in openings in the surface 18 to provide, for example, the staggered helical arrangement of the pockets 22 illustrated in FIG. 1. Of course, other patterns are contemplated. Disposed within each pocket 22 is a releasable comminuting tool assembly or wedge-lock tool insert system, generally designated 24, that includes a tool or tool insert, generally designated 26, and a wedging insert holder, generally designated 28. As will be described, the insert 26 and holder 28 cooperate with one another and the walls of the pocket 22 to facilitate the insertion and removable retention of the insert and holder within the pocket 22.

Figure 2:
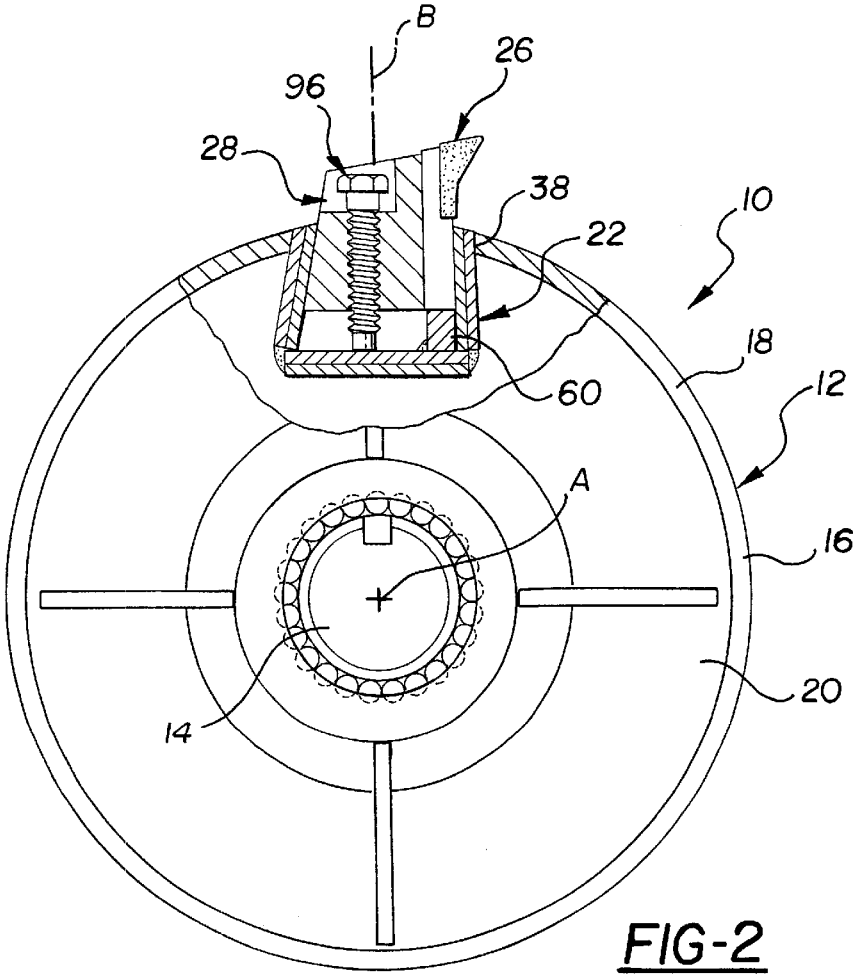
FIG. 2 is an enlarged partly sectional schematic view with a single tool locking system shown in section, taken on the line 2—2 of FIG. 1.
Figure 3:
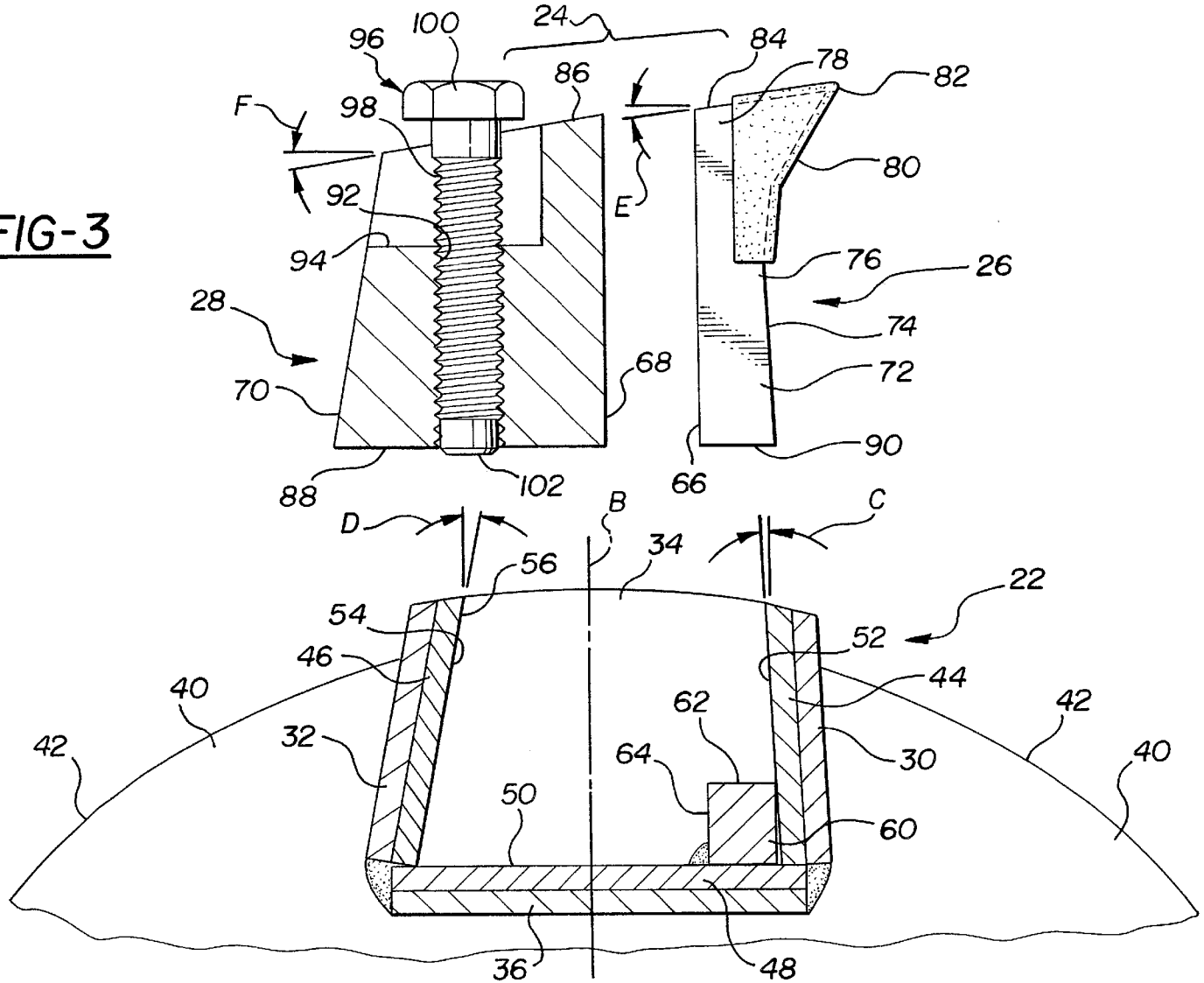
FIG. 3 is a further enlarged partly sectional, fragmentary, exploded side elevational view.
Figure 4:
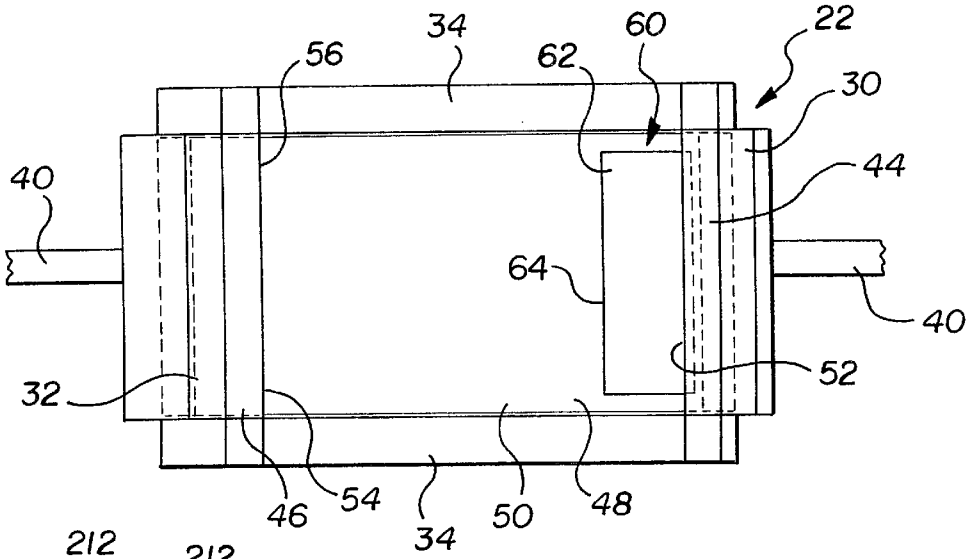
FIG. 4 is a top plan view of the tool locking system.

Turning now to FIGS. 3 and 4, each pocket 22 has a front or leading wall 30, a back wall 32, a pair of side walls 34, and a bottom wall or floor 36. The bottom wall 36 is oriented perpendicularly to an axis B of the respective pocket 22 which intersects the axis A of the shaft 14. The majority of the pocket 22 resides beneath the skin 16 of the drum body 12 and the free ends of the walls 30, 32 and 34 opposite the bottom wall 36 extend through a generally rectangular opening 38 cut in the skin 16 as shown best in FIG. 2. A pair of struts or gusset segments 40 are fixed to the front and back walls 30, 32 and project outwardly therefrom in the form of a segment of a circle having upper arcuate surfaces 42 which conform in shape and size to the inner diameter of the skin 16 and are fixed thereto such as by welding, as a mechanism for securing the inserted pocket 22 within each opening 38 in the skin 16 and reinforcing the pocket and skin under load.

In practice, the insertable pocket modules 22, as shown best in FIGS. 3 and 4, are formed separately from the skin 16 and installed from the inside of the drum in the manner shown in FIG. 2 for ease of construction and installation.

The walls 30, 32, 34 and 36 as well as the gussets 40 are preferably fabricated of steel. The front and back walls 30, 32 of the pocket 22 have liner plates 44, 46 fabricated of a relatively harder grade of steel, such as SAE 4140, which are welded to their respective front and back walls 30, 32. The bottom wall 36 has a bottom liner 48 fabricated of a wear-resistant grade of steel such as AR 400. The tool insert 26 and insert holder 28 are preferably fabricated of a hard grade of steel such as SAE 4140.

The bottom wall 36 and its liner 48 define a floor surface of the pocket 22 disposed perpendicular to the axis B of the pocket. The front wall 30 and its liner 44 present an interior front wall surface 52 of the pocket 22 which extends upwardly from the floor 52 at a predetermined inward front wall angle C so as to incline slightly toward the opposite back wall 32. The back wall 32 and its liner 46 define an inner back wall surface 54 that is also inclined at a predetermine back wall angle D relative to a plane parallel to the axis B of the pocket, and as such inclines slightly toward the opposite front wall 30. In this manner, the width of the pocket opening 56 defined is smaller in dimension between the front and back wall surfaces 52, 54 than the width of the outwardly convergent pocket 22 between the front and back wall surfaces 52, 54 measured adjacent the floor 50 of the pocket 22.

Figure 9:
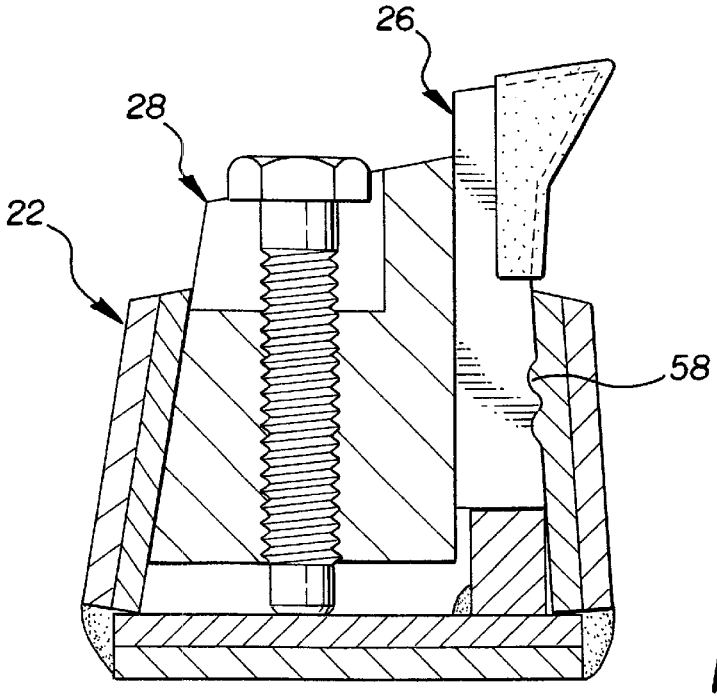
FIG. 9 is a similar view of a slightly modified version with the locking bolt shown in a position in which it has raised the wedge to clamp the tool.

For purposes that will become apparent, the front wall angle C is considerably less than the back wall angle D (i.e., on the order of about a third). In the illustrated embodiment, the front wall angle C is set at about a 3° angle of inclination relative to the axis B, whereas the back wall angle D is inclined at about 10° to the axis B in order to provide a relatively sharper angle. The inclined surfaces 52, 54 preferably extend over at least the majority of the front and back wall surfaces 52, 54. Added features such as the rib-like ridges 58 or serrations shown in the alternative embodiment of FIG. 9 may be provided in addition to the inclined front wall surface arrangement described above and engage corresponding recesses formed in the tool insert.

A spacer block or step 60 of low carbon steel or the like is preferably provided within the pocket 22 at the juncture between the floor 50 and front wall surface 52 to provide a floor front step. The spacer block 60 has an upper surface 62 spaced above the floor proper 50 and an interior surface 64 defining a width of the spacer block 60 that is preferably narrower than the width of the tool insert 26 at its base so as not to interfere with the operation of the insert holder 28, as will become apparent. The spacer block 60 effectively provides an elevated false floor for the pocket 22 which supports the tool insert 26 at all times above the floor 50, seated against the upper surface 62 of the spacer block 60.

Turning now to the wedge-lock tool insert system 24, it will be seen from FIGS. 2 and 3 that the tool insert 26 and insert holder 28 have inwardly facing mating surfaces 66, 68, respectively that are substantially planer and parallel to the axis B of the pocket 22. The insert holder 28 has an outward wedging surface 70 opposite the inward surface 68 set at the reverse complementing angle as that of the back wall angle D (i.e., about 10°). The tool insert 26 has a main body or shank portion 72 which gets clamped in the pocket 22 and has an outward inclined wedging surface 74 set at the complementing reverse angle to that of the front wall angle C of the pocket 22 (i.e., about 3°). As such, the outward wedging surfaces 70, 74 of the holder 28 and insert 26, respectively, are radially forwardly offset with respect to the axis B of the pocket 22 and so are surfaces 66, 68.

The angle of the shank 72 of the insert 26 provides the insert 26 with a relatively wide base that narrows in width at a neck 76 of the insert adjacent the opening 56 of the pocket when mounted therein. Beyond the neck 76, the insert 26 widens from front to-rear to an enlarged head part 78 which comprises a cutting element 80 extending outwardly of the pocket 22 and forwardly of the front wall 30, presenting a leading cutting edge 82 which forwardly overhangs pocket 22. The head 78 of the insert 26 has a top surface 84 set at a saw relief angle E of about 10° relative to a plane perpendicular to the plane of the inward surface 66 so as to drop off to a level lower than that of the leading cutting edge 82 to prevent interference of the head 78 of the insert with the cutting operation of the edge 82. The insert holder 28 also has a top surface 86 that is set at a saw relief angle F of preferably about 10° to provide a continued decrease in height of the wedge-lock tool insert system 24 behind the cutting edge 82 to likewise preclude interference from the insert holder 28 during cutting.

Figure 5:
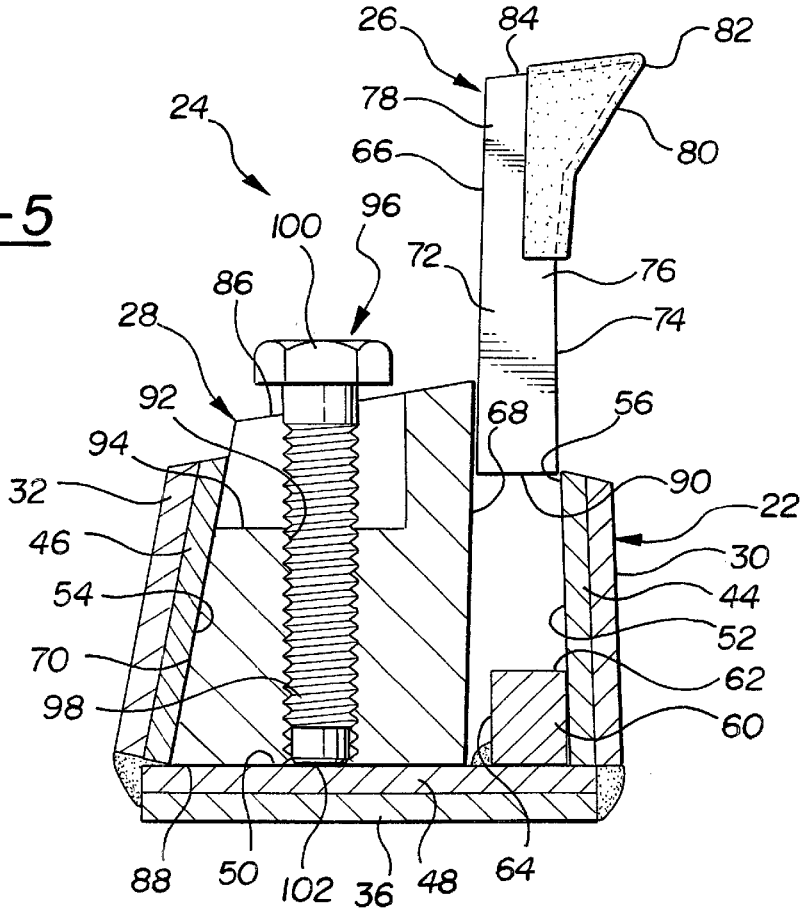
FIG. 5 is a schematic, sectional, side elevational view thereof with the parts shown in a position in which the tool member is being slid into position with the device unlocked.

Turning now to FIG. 5, the wedge-lock tool insert system 24 is installed in the pocket 22 by first extending the insert holder 28 into the pocket 22 as shown, such that a bottom surface 88 of the holder 28 engages the floor 50 of the pocket 22 and the outward wedging surface 70 engages the back wall 54 of the pocket 22. In this position, there is a slight clearance between the inward surface 68 of the holder 28 and the front wall surface 52 at the opening 56 to accommodate the insertion of the tool insert 26 in the pocket 22 to the point where a bottom surface 90 of the insert shank 72 is seated against the upper surface 62 of the spacer block 60 and such that the outward wedging surface 74 of the insert 26 is in full, complementing engagement with the reverse corresponding wedging front wall surface 52 of the pocket 22, as illustrated in FIGS. 5 and 6.

The insert holder 28 has a threaded bore 92 that extends parallel to the axis B of the pocket 22 and the inward surface 68 of the holder 28, and thus is perpendicular to the floor 50 of the pocket 22. The bore 92 extends through to the bottom surface 88 of the holder 28, and the insert holder 28 is countersunk at the opposite end to provide a countersunk recess 94 in the holder 28 spaced below the top surface 86 of the holder. The wedge-lock tool insert system 24 includes a threaded member such as a bolt 96 having a complementally threaded shank 98 provided with an enlarged bolt head 100 at one end and a confronting tip or end 102 at an opposite inner end. The overall length of the bolt 96 is greater than the height of the insert holder 28, such that when the shank 98 is received in the threaded bore 92 of the holder with the confronting tip 102 at or above the bottom surface 88 of the holder 28, the head 100 of the bolt 96 projects above the top surface 86 of the holder 28, as shown best in FIGS. 5 and 6.

Upon advancing the bolt 96 to extend the shank 98 out through the bottom of the bore 92, the tip 102 of the bolt 96 confronts the floor 50 of the pocket 22 and, upon further advancement of the bolt 96, causes the insert holder or wedge 28 to be drawn outwardly or upwardly relative to the bolt 96 and walls of the pocket 22, which remain axially stationary. Such upward movement of the insert holder 28 causes the outward wedging surface 70 of the holder to interact with the back wall surface 54 of the pocket 22, wherein the holder 28 is also caused to be displaced laterally forwardly toward the tool insert 26 until such time as the inward surfaces 66, 68 engage. Still further advancement of the insert holder 28 urges the tool insert 26 in the lateral direction toward the front wall surface 52. The non-angular mating inward surfaces 66, 68, along with the slight wedging angle between the outward wedging surface 74 of the insert 26 and the angled front wall surface 52 of the pocket 22 ensure that the tool insert 26 is held against axial outward movement during the tightening of the insert holder 28, such that the bottom surface 90 of the insert 26 remains in contact with the upper surface 62 of the spacer block 60. In this way, it is assured that the radial location of the cutting edges 82 of the numerous inserts 26 about the drum body 12 are properly positioned in the desired radial cutting plane and do not move out of that cutting plane during clamp up. Once fully tightened, each insert 26 cannot be removed from its pocket 22 without first releasing the wedge lock of its holder 28, as will now be described.

Figure 6:
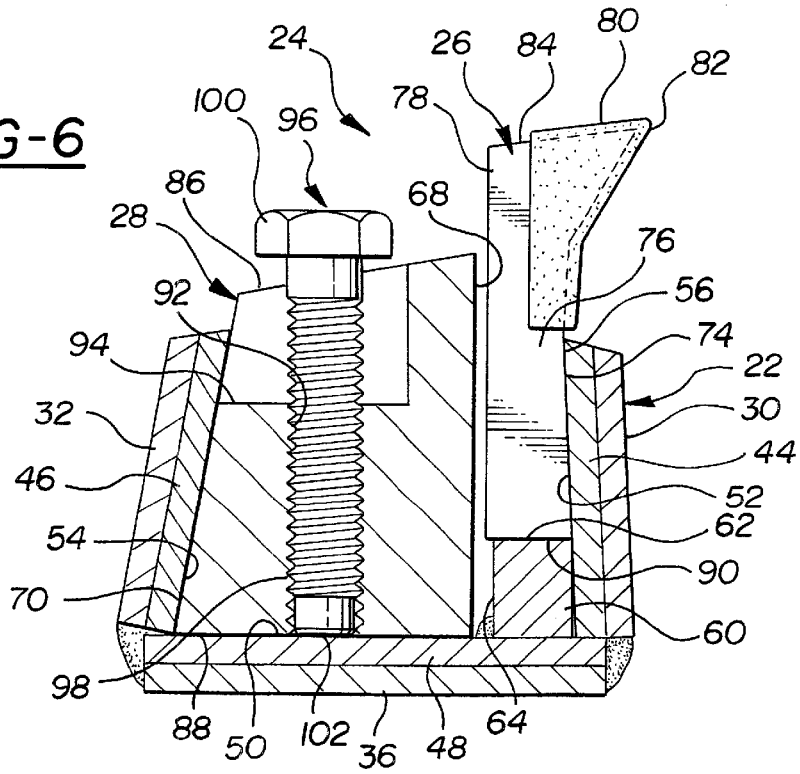
FIG. 6 is a similar view with the tool shown in position to be clamped.
Figure 7:
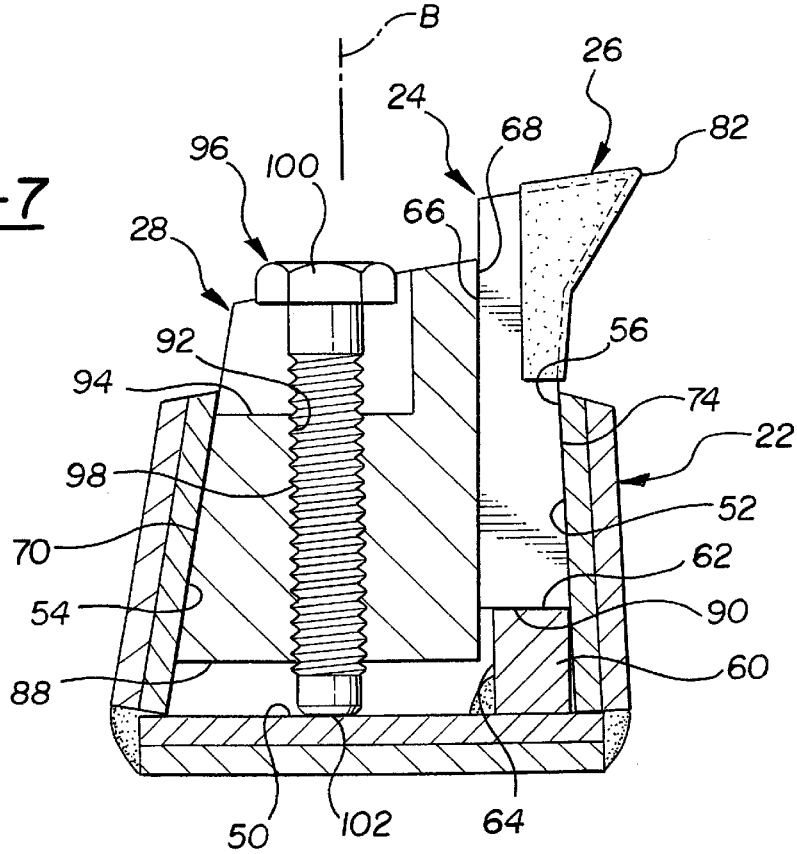
FIG. 7 is a similar view with the wedge bar being moved upwardly in the process of clamping the tool.
Figure 8:
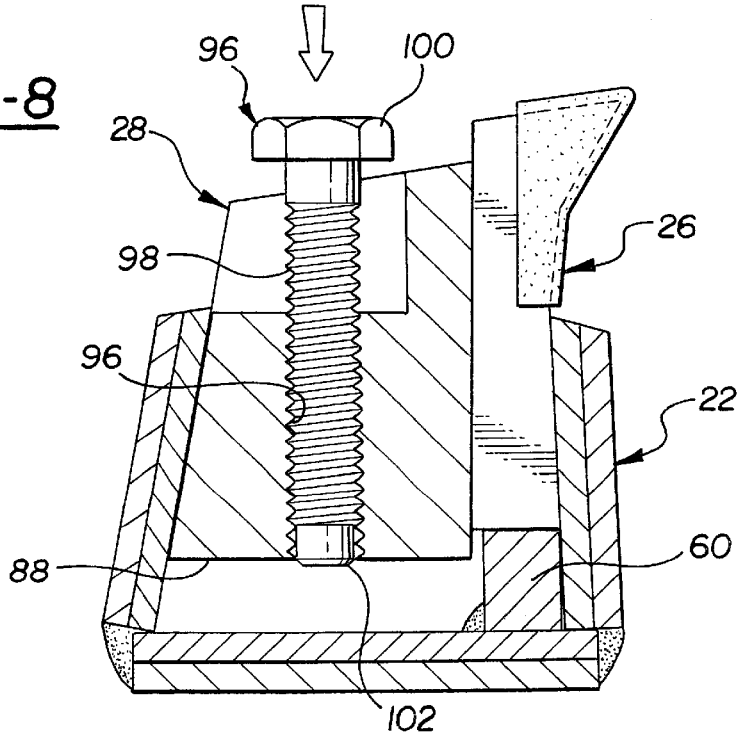
FIG. 8 illustrates the raised position of the wedge bolt when the tool is to be unlocked.

When it is desired to remove the tool insert or tool 26 from the pocket, after it has been installed in the manner described above, one simply backs off the bolt 96 to the point where the shank 98 is retracted into the bore 92 and the head 100 projects above the top surface 86 of the holder, as shown in FIG. 7, after which an operator may simply tap the head of the bolt with a hammer or the like with sufficient force to overcome the wedge lock, knocking the insert holder 28 back into the pocket to the position shown in FIG. 6. This creates a clearance gap that enables a worn tool insert 26 to be easily lifted free of the pocket 22 and replaced.

Figure 10:
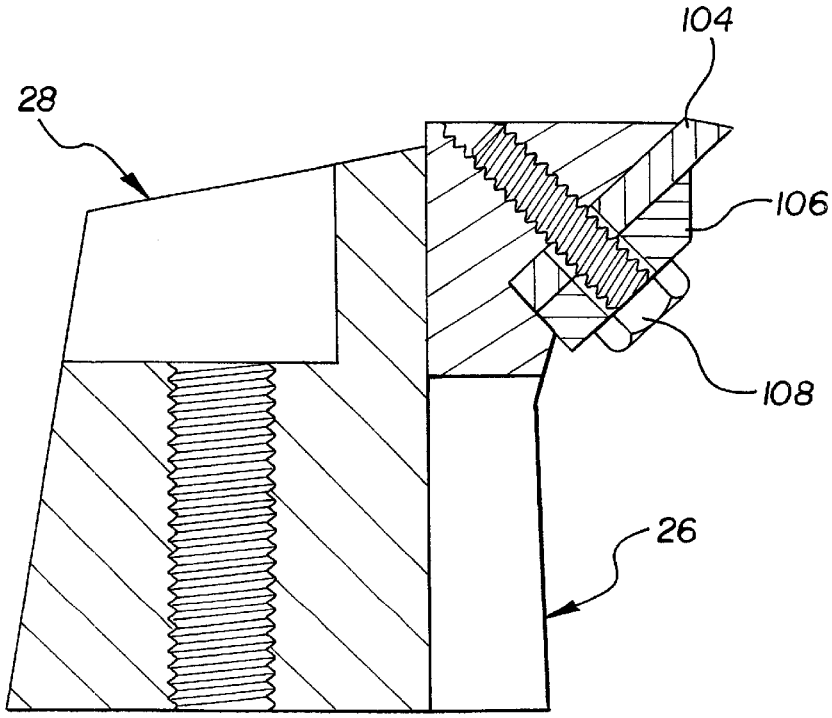
FIG. 10 is a sectional side elevational view showing an alternate tool head.

One advantage of the present invention is that the wedge lock tool insert system 24 provides a universal mounting system for various tool insert configurations having a variety of cutting head configurations, such as the alternative insert shown in FIG. 10, wherein a cutting knife 104 is mounted by a cover plate 106 and bolt 108 to the head of the insert in lieu of the hard carbide tool facing provided on the insert of FIGS. 1–8. It will thus be appreciated that the base of the various inserts will have the same configuration for universal mounting in the pockets 22 by means of the insert holder 28 as described previously, while the head of the inserts may take on any of a number of configurations suitable for each particular comminuting operation.

Figure 11:
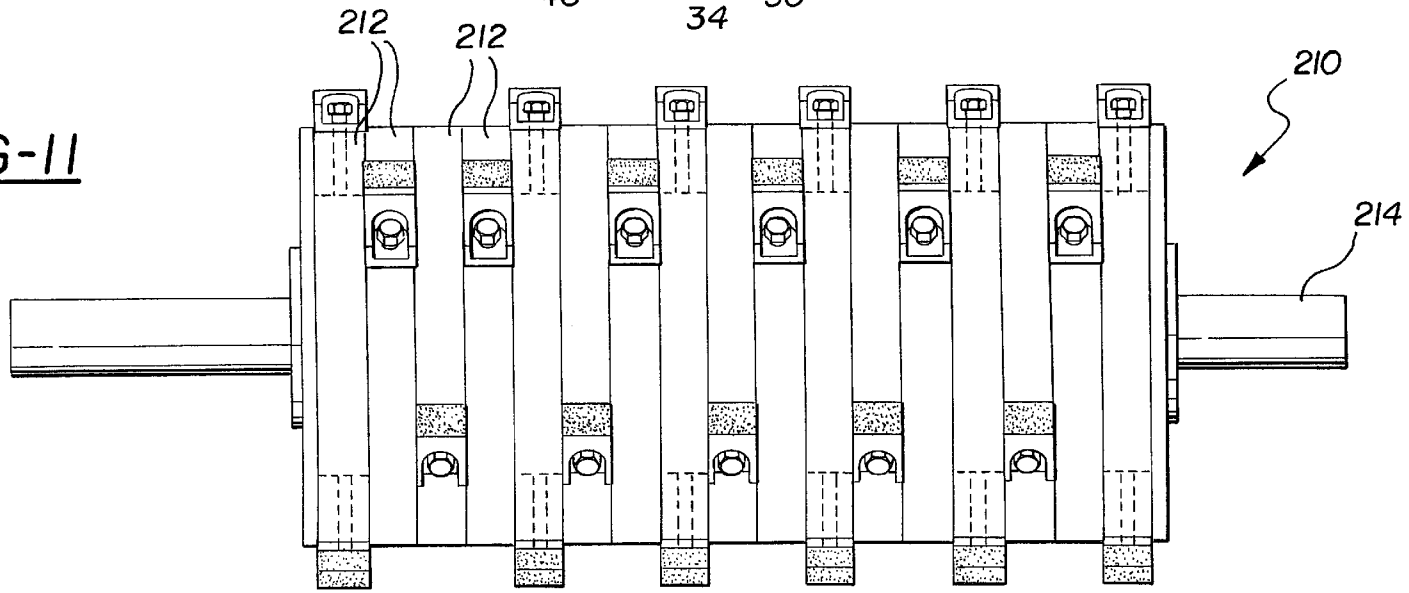
FIG. 11 is a side elevational view illustrating another form of drum.
Figure 12:
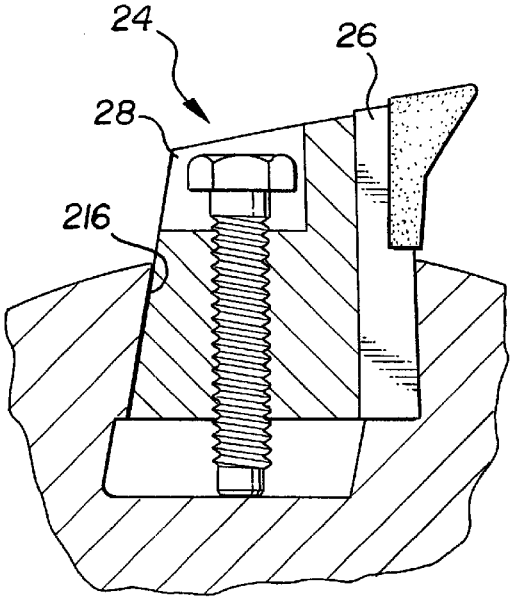
FIG. 12 illustrates the manner in which pockets are provided in the various radially extending disc elements which make up the drum.
Figure 13:
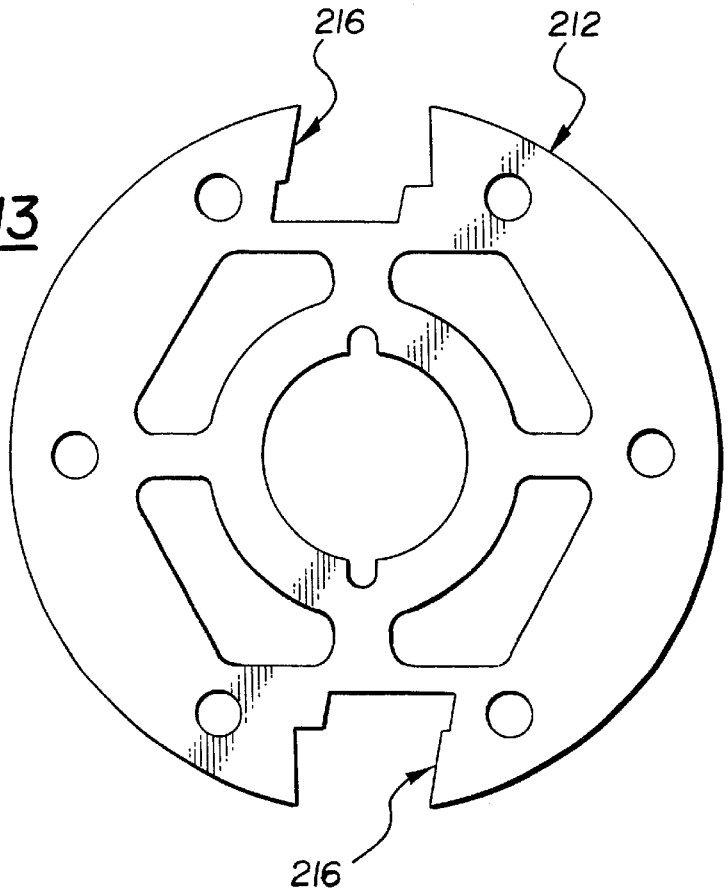
FIG. 13 is a side elevational view of one of the elements only.
Figure 14:
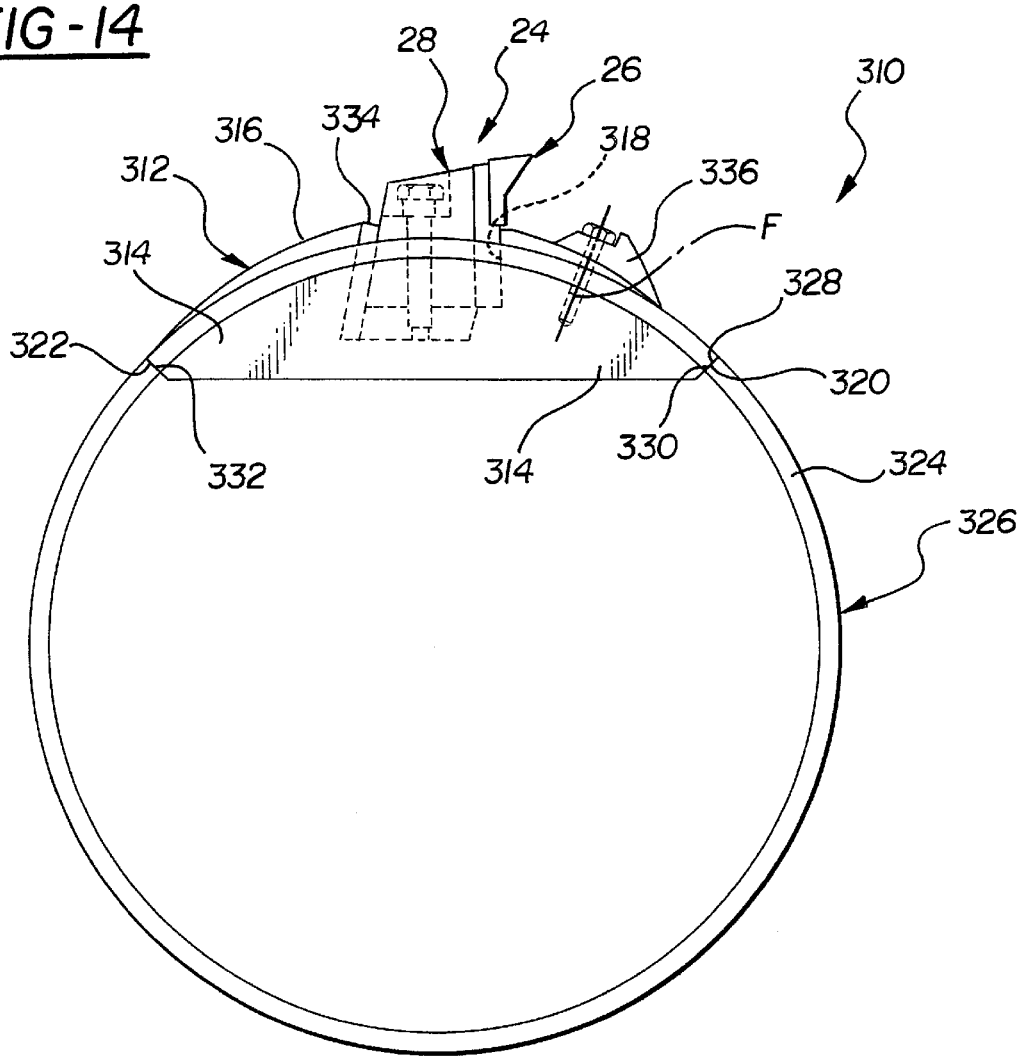
FIG. 14 is a schematic side elevational view illustrating the manner in which a segment device providing the pocket may be incorporated.
Figure 15:
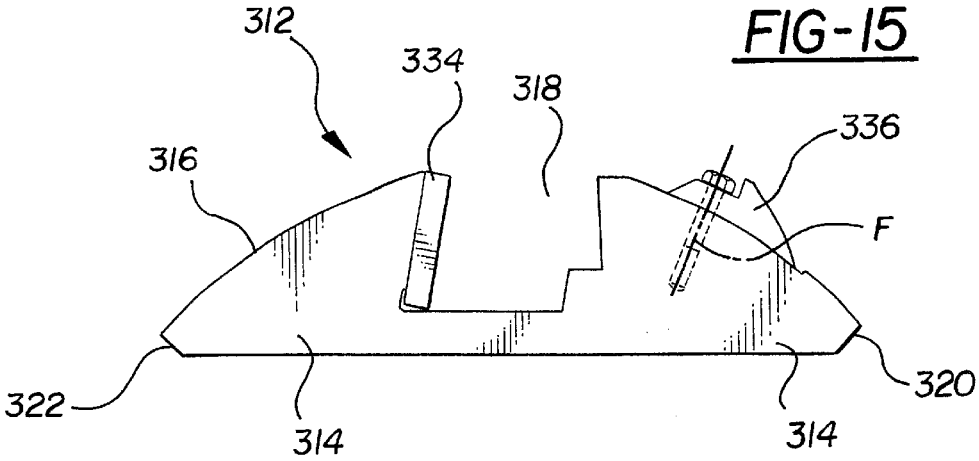
FIG. 15 is a side elevational view of the segment device only.
Figure 16:
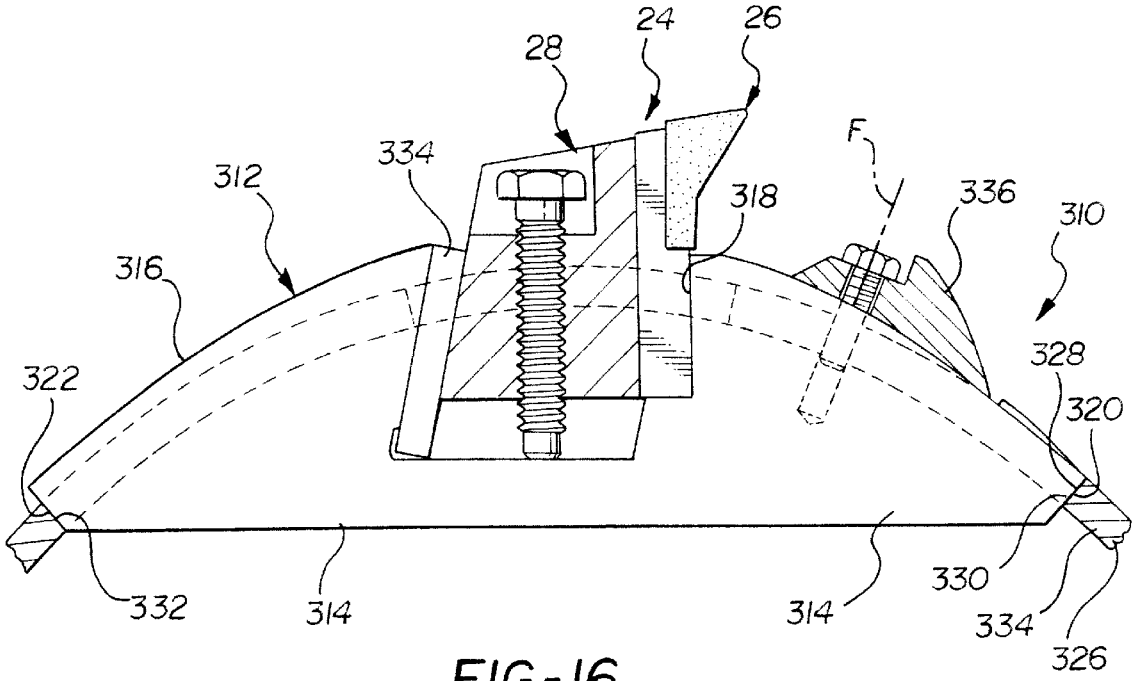
FIG. 16 is an enlarged fragmentary view more particularly illustrating the manner in which the segment device can be mounted in a drum element.
Figure 17:
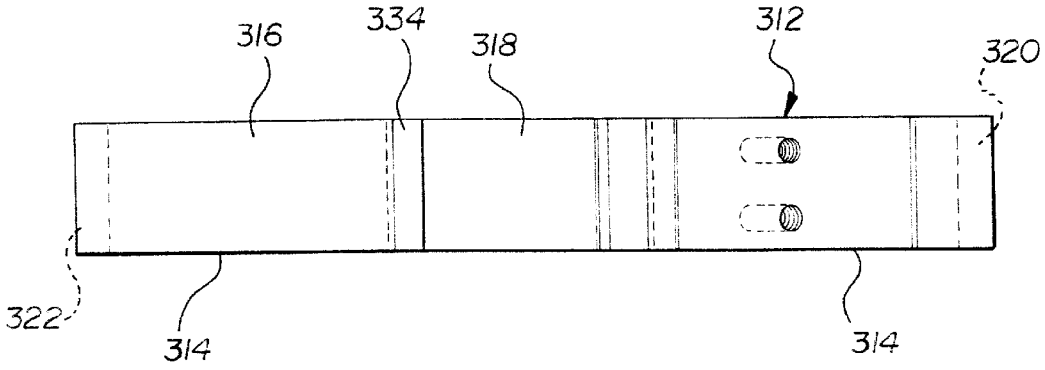
FIG. 17 is a top plan view thereof.

FIGS. 11–13 illustrate an alternative drum configuration 210 in which the drum body is made up of a series of drum plates or discs 212 stacked in succession on a shaft 214 and each formed with a pocket 216 of generally the same configuration as the pocket 22, except that the wall surfaces are machined in the drum plate material. The floor of the pocket 26 is likewise stepped at 218 except, again, the stepped contour is achieved by machining the drum plates, rather than providing a separate spacer block as in the first embodiment, although such a spacer block could be employed. It will be appreciated, in both embodiments, that the stepped floor 218 of the pocket elevates the tool insert 26 and thus shortens the required length of the main body or shank 72 of the insert. This has the advantage of reducing the amount of material required to make inserts, thereby lowering the cost of the inserts. The plates 212 are shown formed with a series of cut-outs 216 for removing material and thereby reducing the weight of the plates 212, but it will be understood that the cut-outs 216 could be reduced in size or be eliminated within the scope of the invention. The wedge-lock tool insert system 24 works in the same manner in the pocket 216 of the stacked drum plate arrangement of FIGS. 11–13, and shares the same advantages.

FIGS. 14–17 illustrate yet another embodiment of the invention in which the drum assembly 310 has a pocket module 312 fabricated of a relatively thick plate of steel, such as SAE 4140. The pocket module 312 may have a thickness of about three inches with full thickness gussets 314 as shown best in FIG. 17, unlike the gussets 40 of FIGS. 1–3 of the first embodiment.

The pocket module 312 has a generally cylindrical outer surface 316 formed with a pocket-defining recess 318 having the same general configuration as the pockets 22, 216 of the previous embodiments for mounting the wedge lock tool insert assembly 24. The assembly is identical to the previous embodiments and thus the same reference numerals will be used to reference its components and features.

The pocket module 312 terminates at its ends with truncated seats or shoulders 320, 322. The skin 324 of the drum 326 is formed with openings 328 to receive the pocket modules 312. Each opening 328 is sized relative to its associated pocket module 312 to provide a front shoulder 330 and a back shoulder 332 for engaging the shoulders 320, 322 of the associated pocket module 312 as illustrated best in FIG. 16. The module is permanently fixed to the skin 324 by weldments at the shoulder interfaces.

The pocket recesses 318 are machined in the same way as the second embodiment of FIGS. 11–13 preferably from a relatively hard, strong grade of steel, such as SAE 4140, but oversized relative to the back wall so as to accommodate a replaceable wear insert 334, which may likewise be fabricated of SAE 4140. The pocket recess 318 presents the same surfaces provided at the same angular relationship as described above with respect to the pocket surfaces of the first embodiment for engaging the wedge lock insert 24 in identical fashion.

The pocket modules 312 may include a deflector member 336 secured to the outer surface 316 at a location ahead of the pocket recesses 318. The deflector members may be secured by fasteners F or the like to enable them to be selectively removed when worn or damaged, or for replacement with deflector members of greater or lesser height for controlling the effective working depth and thus the aggressiveness of the tool insert 26.

The disposition of the tool bearing against the front face of the pocket along with the differential angles of inclination wherein the inclination of the back face of the pocket is greater provides greater rigidity, more secure clamping, better capability of withstanding the severe impact forces and more rapid release and replacement of the tool.

The operation of the wedge lock insert 24 in the pocket recess 318 of the FIGS. 14–17 embodiment is identical to that previously described with respect to the first embodiment of FIGS. 1–8.

It is to be understood that the embodiments described are exemplary of various forms of the invention only and that the invention is defined in the appended claims which contemplate various modifications within the spirit and scope of the invention.

We claim:

1. A rotor assembly for comminuting scrap wood and other like material comprising:

a. a rotor drum including a drive shaft for rapidly rotating said rotor drum in a forward direction of travel and further including at least one radially projecting tool supporting member having a peripheral surface with at least one tool assembly receiving pocket provided therein having an inclined front wall and an oppositely inclined rear wall extending outwardly from a pocket floor;

b. a releasable comminuting tool comprising an elongate shank, with a cutting head thereon having a cutter tooth with a leading cutter edge facing in said direction of travel, received in said pocket and bearing upon said front wall of said pocket, said shank having an inclined front wall surface and being received to dispose said cutting head outwardly of said pocket; and c. a wedge including a rear inclined surface bearing upon said rear wall of said pocket and a front wall bearing upon said tool shank, said wedge having a threaded opening with an elongate threaded abutment member therein having an inner end extending to bear upon said pocket floor manipulatible to draw said wedge member outwardly when manipulated with its inner end in bearing engagement with said pocket floor, said angle of inclination of said inclined rear wall of said wedge being greater than the angle of inclination of said inclined tool shank surface to provide a differential inclination.

2. The rotor assembly of claim 1 wherein said pocket is intersected by a radial axis also intersecting the axis of said drive shaft and said tool shank is disposed well forwardly of said radial axis, and said front surface of said wedge and rear surface of said tool shank extend parallel to said radial axis.

3. The rotor assembly of claim 2 wherein said differential inclination is on the order of three to one.

4. The rotor assembly of claim 3 wherein said front wall of the tool shank and front wall of the pocket are in mating engagement and extend outwardly at an angle of about 3 degrees relative to a plane parallel to said radial axis, and said inclined wedge rear wall and said rear wall of said pocket are in mating engagement and extend outwardly at an angle of about 10 degrees relative to a plane parallel to said radial axis.

5. The rotor assembly of claim 4 wherein said tool head comprises a wedge shaped body provided on said tool shank and has outer and front side relief surfaces extending from said cutter edge.

6. The rotor assembly of claim 5 wherein said abutment member is a bolt with its head received in a recess provided in an outer relieved surface of said wedge, said wedge extending outwardly in locked position to substantially a relieved surface of said tool to brace said tool.

7. The rotor assembly of claim 1 wherein said drum is formed by a series of substantially axially adjacent tool supporting members.

8. The rotor assembly of claim 1 wherein said drum is formed of a drum shaped tool supporting member.

9. The rotor assembly of claim 1 wherein said floor incorporates a raised step beneath said tool shank which is engaged by the inner end of said tool shank.

10. The rotor assembly of claim 1 wherein said pocket is provided in a segment having curvilinear outer walls conforming to the interior of said tool supporting member and said segment fixes to said drum.

11. The rotor assembly of claim 1 wherein a deflector member is removably secured to said segment forwardly of said pocket.

12. A rotor for comminuting scrap wood and other like material comprising:

a. a rotor drum including a drive shaft for rapidly rotating said rotor drum in a forward direction of travel and further including at least one radially projecting tool supporting member having a peripheral surface with at least one tool assembly receiving pocket provided therein and having a front wall and a rear wall extending convergently outwardly from a pocket floor having a front step;

b. a releasable comminuting tool comprising an elongate shank, with a cutting head thereon having a cutter tooth with a leading cutter edge facing in said direction of travel, received in said pocket on said step to dispose said head outwardly of said pocket in bearing engagement with said front wall of said pocket; and c. a wedge including a rear inclined surface bearing upon said rear wall of said pocket and a front wall bearing upon said took shank, said wedge having a threaded opening extending substantially perpendicularly to said pocket floor with an elongate threaded abutment member therein having an inner end extending to bear upon said pocket floor rearwardly of said step manipulatible to draw said wedge outwardly from an inward position to a shank locking position when manipulated with its inner end in bearing engagement with said pocket floor, said wedge from front to rear being of such width as to leave a gap between said wedge front wall and step and said wedge front wall and tool shank when the wedge is in said inward position.

13. The rotor assembly of claim 12 wherein said pocket is bisected by a radial axis and said tool shank is disposed well forwardly of said radial axis, and said front surface of said wedge and rear surface of said tool shank extend parallel to said radial axis.

14. The rotor assembly of claim 13 wherein said front wall of said pocket and front wall of said tool shank are so less inclined with respect to said rear wall of said pocket as to create a differential inclination on the order of three to one.

15. The rotor assembly of claim 14 wherein said front wall of the tool shank and front wall of the pocket are in mating engagement and extend outwardly at an angle of about 3 degrees relative to a plane parallel to said radial axis, and said inclined wedge rear wall and said rear wall of said pocket are in mating engagement and extend outwardly at an angle of about 10 degrees relative to a plane parallel to said radial axis.

16. The rotor assembly of claim 15 wherein said abutment member is a bolt with its head received in a recess provided in an outer relieved surface of said wedge, said wedge extending outwardly in locked position to substantially a relieved surface of said tool to brace said tool.

17. The rotor assembly of claim 12 wherein said drum is formed by a series of axially adjacent tool supporting members.

18. The rotor assembly of claim 12 wherein said drum is formed of a drum shaped tool supporting member.

19. The rotor assembly of claim 12 wherein said pocket is provided in a segment having curvilinear outer walls fixed to the interior of said tool supporting member and a deflector member is removably secured to said segment forwardly of said pocket.

20. A method of constructing a rotor for comminuting scrap wood and other like material comprising:

a. providing a rotor drum including a drive shaft for rapidly rotating said rotor drum in a forward direction of travel and further including at least one radially projecting tool supporting member having a peripheral surface with at least one tool assembly receiving pocket provided therein which has a front wall and a rear wall extending outwardly from a pocket floor;

b. installing a tool having an elongate shank, with a cutting head thereon having a cutter tooth with a leading cutter edge facing in said direction of travel, in said pocket and bearing upon said front wall of said pocket;

c. installing a wedge, including a rear inclined surface bearing upon said rear wall of said pocket and a front wall bearing upon said tool shank, in said pocket, said wedge having a threaded opening with an elongate threaded abutment member therein having an inner end extending to bear upon said pocket floor manipulatible to draw said wedge member outwardly when manipulated with its inner end in bearing engagement with said pocket floor; and d. providing said front wall of said tool shank as a tool shank surface inclined substantially less than the angle of inclination of said wedge inclined rear surface.

* * * * *